US006471149B1

(12) United States Patent
Bohm

(10) Patent No.: US 6,471,149 B1
(45) Date of Patent: Oct. 29, 2002

(54) GAP MILL

(75) Inventor: Arturo Bohm, Oberuzwil (CH)

(73) Assignee: Buhler AG, Uzwil (CH)

( * ) Notice: Subject to any disclaimer, the term of this patent is extended or adjusted under 35 U.S.C. 154(b) by 0 days.

(21) Appl. No.: 09/615,788

(22) Filed: Jul. 13, 2000

Related U.S. Application Data

(63) Continuation-in-part of application No. 09/202,983, filed as application No. PCT/CH97/00234 on Jun. 12, 1997, now abandoned.

(30) Foreign Application Priority Data

Jun. 29, 1996 (DE) ..... 196 26 246

(51) Int. Cl.[7] ..... B02C 19/00
(52) U.S. Cl. ..... 241/162; 241/261.1
(58) Field of Search ..... 241/257.1, 261.1, 241/293, 146, 161, 162, 163, 253, 252, 251, 250

(56) References Cited

U.S. PATENT DOCUMENTS

| | | | | |
|---|---|---|---|---|
| 2,778,282 A | * | 1/1957 | Sutherland | 241/250 |
| 2,963,232 A | * | 12/1960 | Smith | 241/162 |
| 4,196,224 A | * | 4/1980 | Falk | 241/261.1 |
| 4,261,521 A | | 4/1981 | Ashbrook | |
| 4,721,260 A | * | 1/1988 | Genev | 241/252 |
| 4,964,580 A | * | 10/1990 | Akesaka | 241/252 |

FOREIGN PATENT DOCUMENTS

| | | |
|---|---|---|
| DE | 401477 | 9/1924 |
| DE | 3440091 | 5/1986 |
| EP | 0685533 | 12/1995 |
| GB | 2039225 | 8/1980 |
| WO | 88/03052 | 5/1988 |
| WO | 93/14925 | 5/1996 |
| WO | 96/14925 | 5/1996 |

OTHER PUBLICATIONS

German Publication "Inflow technique Processes for Producing Functional Structures in Multiphase Food Systems", by E.J. Windhab, Lebensmittel–Technologie 29/No. 4/96.
Dipl.–Ing. Hans Reichert thesis 1973, University of Karlsruhe.
German Publication "Analysis of Agglomerate Rupture in Linear Flow Fields", by Manas–Zloczower, International Polymer Processing IV, pp. 3.

* cited by examiner

*Primary Examiner*—Mark Rosenbaum
(74) *Attorney, Agent, or Firm*—Greenblum & Bernstein, P.L.C.

(57) ABSTRACT

Process and apparatus for reducing the size of particles of a flowable material. The process includes a stream of the fluid and the particles that is fed under pressure. The particles are subjected to expansion forces in a first dimension while they are simultaneously fed through at least one continuously narrowing constriction. While the particles in the fluid are conveyed through the narrowing constriction, they are subjected also to expansion forces in a second dimension. The apparatus may include a device which pressurizes the fluid and its particles which are fed through at least one inlet into a space. This space is defined from two sides only by at least one pair of opposing walls. Thus, the walls form a narrowing constriction up to a gap of smallest cross-section. This gap communicates with the outlet.

23 Claims, 9 Drawing Sheets

GAP MILL

CROSS-REFERENCE TO RELATED APPLICATIONS

The present application is a Continuation-in-Part of U.S. patent application Ser. No. 09/202,983 filed Dec. 23, 1998 now abandoned, which is a U.S. National Stage Application of PCT/CH97/00234 filed Jun. 12, 1997, and which claims priority of German Patent Application No. 196 26 246.1 filed Jun. 29, 1996, the disclosures of each of these documents being expressly incorporated by reference herein in their entireties.

FIELD OF THE INVENTION

The invention relates to a process and an apparatus for comminuting, dispersing, desagglomerating and/or mixing flowable material in chemical industry, ink making industry, textile industry, pharmaceutical industry, cosmetic industry and food industry. Particularly, e.g., dispersing and/or desagglomerating of ink pigments or blending of plastic material.

BACKGROUND OF THE INVENTION

Devices known heretofore for carrying out the procedures mentioned above relate mainly to mills having rotary components, such as agitator mills, roller mills or other devices where shearing forces basically act upon the particles to be treated.

Likewise, inflow technique processes are known (see E. J. Windhab: "Inflow Technique Processes for Producing Functional Structures in Multiphase Food Systems", Lebensmittel-Technologie 29/No. 4/96). By a combination of thermal and mechanical stress of multiphase fluid systems, a specific production or alteration of disperse structures can be achieved in well-defined flow fields (e.g., shearing flows).

Investigations have confirmed that, apart from shearing flows, expansion flows can also be used for treating the materials corresponding to the above applications [see Reichert, thesis 1973, University of Karlsruhe as well as Manas-Zloczower and D. L. Feke, International Polymer Processing IV(1989), pp. 3-8 ]. It has been shown that, apart from a shearing flow, further forms of flow, such as expansion flows, exist which are considerable more effective as to specific energy and time of treatment.

Expansion flows have already been used earlier. GB-A-2,039,225 discloses a succession of nozzles of converging and then enlarging cross-sections. It is shown that particles flowing through the converging section are laterally compressed and expand in length up to the moment where the particles pass the smallest cross-section of the nozzle and are torn into fines. The use of nozzles, however, compresses the particles from all sides so that the particles expand in one dimension only, i.e., in length. Therefore, to achieve proper comminution, a series of nozzles is necessary. Moreover, since nozzles have a very limited cross-section, the quantity of fluid passing through per time unit is very much restricted so that this nozzle arrangement has not found any acceptance on the market due to its reduced efficiency.

SUMMARY OF THE INVENTION

Therefore, the present invention provides a process and an apparatus which mainly use expansion forces for treating, particularly comminuting, dispersing, disagglomerating and/or mixing, flowable materials where the material is treated in a more efficient manner. In particular, the apparatus does not require moving components.

According to the invention, the problem is solved by a process in which the material is almost exclusively subjected to two-dimensional expansion forces within a stream. "Two-dimensional" refers to expansion both in length and in width. In this way, seemingly a double effect is achieved, but in reality the comminution effect is multiplied so that an apparatus according to the invention can be very much simplified, nevertheless working more efficiently and allowing a considerable throughput.

In practice, the above problem may be solved by an apparatus, called a "gap mill," for reducing the size of particles of a flowable material in a streaming fluid. According to the present invention, the apparatus includes a pressurizing device, such as at least one of a compressor (for air and gases) or a pump (for liquids) which feeds the fluid under pressure together with the particles through an inlet into an open space. This space is only confined by a pair of opposing wall surfaces delimiting the space. These wall surfaces are narrowing to each other up to a gap of smallest cross-section An outlet communicates with the gap to discharge the fluid which then contains the particles in comminuted, dispersed, desagglomerated and mixed form.

Such a mill according to the invention does not necessarily include any movable component except for the conveying elements, such as a pump. The desired tension condition within the stream is achieved in that the product is pressed through a converging gap of the mill. In the course of this, the power required has to be raised in form of pumping power. Investigations have shown that the stress on agglomerates are comparable with that within the roll gap of a roller mill with respect to tension level, number of stressing and specific energy.

The walls of the mill can be in the form of base bodies which are substantially conical of a predetermined maximum radius wherein the inlet is radially outwards, while the outlet is radially inwards and the constriction and gap is in the center. Of course, this arrangement could be inverted by providing two hollow cones with the inlet in the center, while the outlet and the gap are radially outwards, but this is not preferred.

The gap mills according to the invention can be combined in a process with agitator mills, roller mills or similar devices known per se by preponing, interposing and/or postponing them.

According to an aspect of the present invention, an apparatus for at least one of comminuting, dispersing, desagglomerating and mixing flowing material is provided. The apparatus includes a gap mill having a pair of cylindrical frustro conical shaped base bodies with a wide base surface and a truncated conical end, wherein each base body has an axially centered bore. The frustro conical shaped bodies are positioned so that the bores of the bodies are axially aligned, and form a thin gap between the truncated conical ends of the base bodies. An annular space is defined between the pair of base bodies of the gap mill.

According to another aspect of the present invention, the annular space has a cross-sectional shape of two funnels connected together at their spout ends. In another aspect of the present invention, the annular space has a cross-sectional shape of a hyperbola.

According to a further aspect of the present invention, the apparatus includes an outer jacket connected to the wide base surfaces of the pair of cylindrical frustro conical shaped base bodies arranged to enclose the annular space. At least one inlet bore penetrates through the outer jacket, wherein the flowing material enters said at least one inlet bore, flows through the annular space, enters said axially centered bores via the thin gap, and exits through one of said axially centered bores.

In another aspect of the present invention, a plurality of the gap mills are stacked together forming a "parallel connection" gap mill. The "parallel connection" gap mill includes a plurality of axially centered bores axially aligned to form a central "series" bore having two main outlet exits. Each of the plurality of gap mills include an annular space. At least two "series" inlet bores including a plurality of inlet bores, each at least one inlet bore is coupled to each annular space.

According to a still further aspect of the present invention, the apparatus further includes at least one supply container and at least one pump arranged to form a closed-loop flow path such that the flow material continuously flows through the pump, the gap mill, and the supply.

In yet another aspect of the present invention, at least one supply container connected to a plurality of gap mills which are arranged so that said axially centered bores are axially aligned. A pump is arranged upstream of each gap mill and a receiving container connected to the outermost the axially centered bores of the plurality of gap mills.

According to a further aspect of the invention an apparatus for at least one of comminuting, dispersing, desagglomerating and mixing flowing material is provided. The apparatus includes a cylindrical frustro conical shaped body having a wide base surface, truncated conical end, an axially centered bore; and a planar body. The cylindrical frustro conical shaped body and the planar body are arranged to form an annular space, and a thin gap between the truncated conical end and the planar body.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
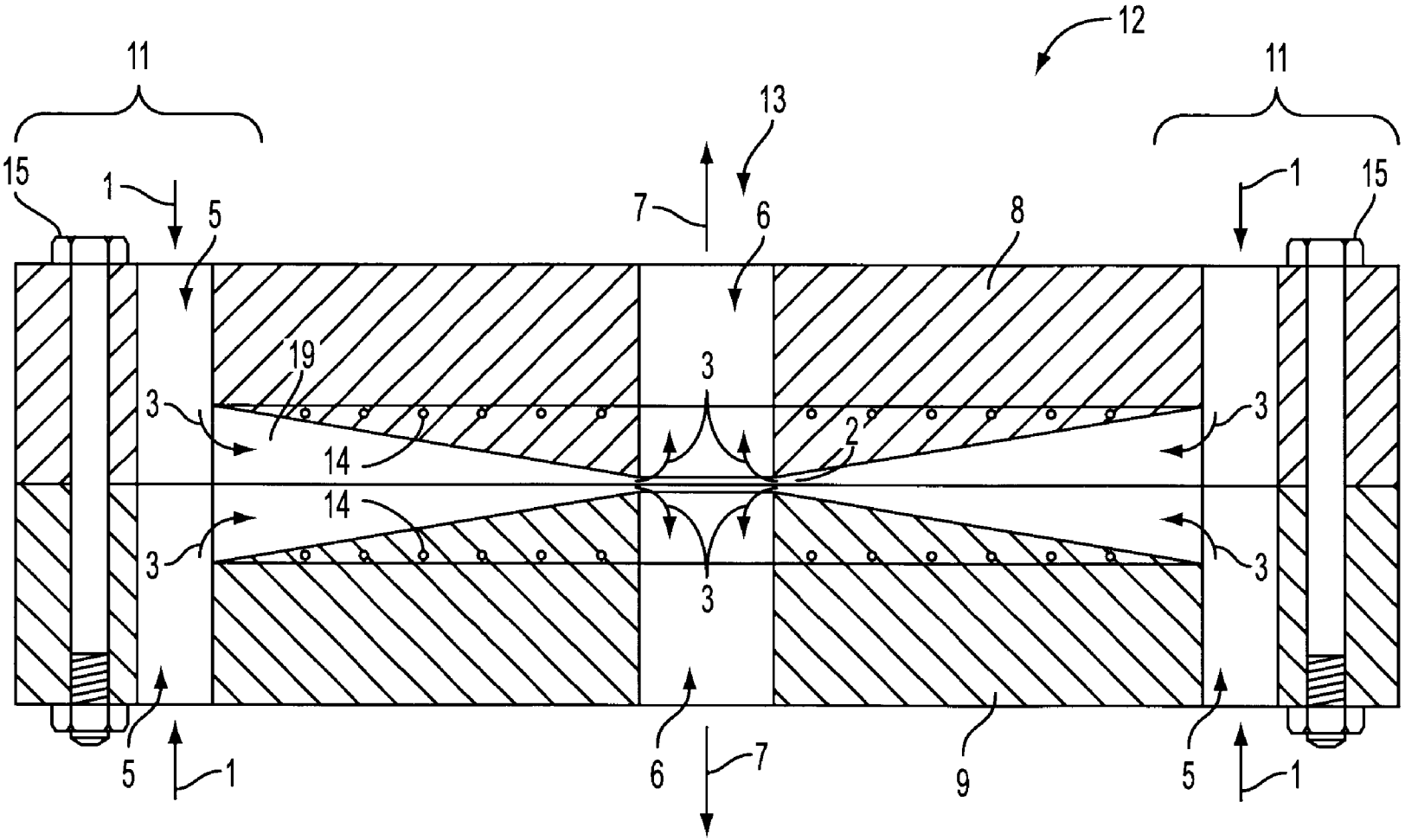
FIG. 1 is a basic representation of a gap mill according to the invention in a cross-sectional view.

A gap mill 12, as shown in FIG. 1, is constructed from two opposing and congruent base bodies 8 and 9. The base bodies 8 and 9, made in one or a plurality of parts, may have a rectangular cross-section, a symmetrical one with respect to rotation or any other conceivable cross-section adapted to leave free space between them in a direction perpendicular to the plane of FIG. 1 for reasons explained below. The base bodies 8 and 9 delimit a free space 19 narrowing more and more towards the gap 2. Preferably, the walls of the base bodies, which face each other, are continuously narrowing, although it would be conceivable in small steps or, as described later, in a curved shape.

In the outer region 11 of the base bodies 8 and 9, there are bores as an inlet 5 for the material 1 to be treated, and in the center 13 are bores as a outlet 6 for discharging the material 7 when treated. This material 1 contains particles to be comminuted in a fluid. The base bodies 8 and 9 are formed in such a manner that they comprise a constriction or gap 2 together from which the bores 6 run off. In order to leave space in the direction perpendicular to the plane of FIG. 1, thus enabling expansion of particles fed in, the gap 2 may be in form of a slot (if the base bodies 8 and 9 are rectangular, the length extending in this perpendicular to the plane of case, the space 19 will also be elongated in a direction perpendicular to the plane of FIG. 1 and a plurality of inlet bores 5 can be distributed along its length. Alternatively, as shown in FIG. 1, the gap is annular and surrounded by a substantially annular space 19 which is narrowing from all sides towards the gap 2.

Material 1 fed under pressure through the inlet bores 5 enters the more and more constricting space 19, thereby being subjected to pressure from above and below. This results normally in an expansion in longitudinal direction, i.e., in the direction of entering flow according to arrows 3. By providing a free space also in width, i.e., in the direction perpendicular to the plane of FIG. 1, the particles will also expand in this, second dimension, thus multiplying the effect of expansion. The one-dimensional effect is already known, but by providing a two-dimensional expansion, the particles are torn in fines more effectively, as will be explained with reference to FIG. 9.

The constricted space 19 enlarges in the direction to the outer region 11 of the base bodies 8 and 9 towards the inlet bores 5. Preferably, the base bodies 8 and/or 9 can be provided with heating or cooling elements 14. Farther in the outer region are fastening bolts 15 (or any other mounting device) for holding the base bodies 8 and 9 together. Arrows 3 indicate the direction of flow.

Figure 2:
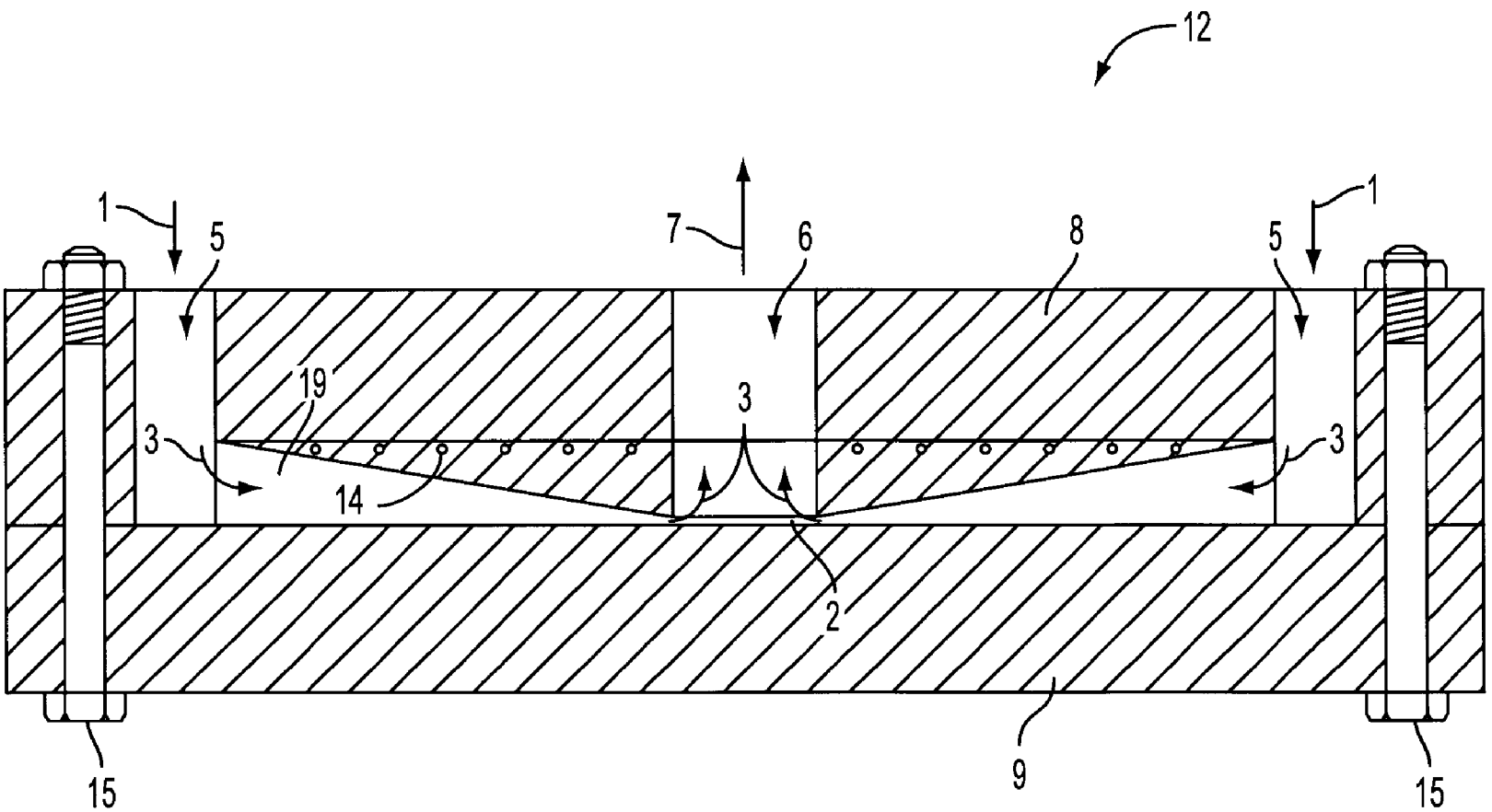
FIGS. 2 and 3 illustrate different embodiments of a gap mill.
Figure 3:
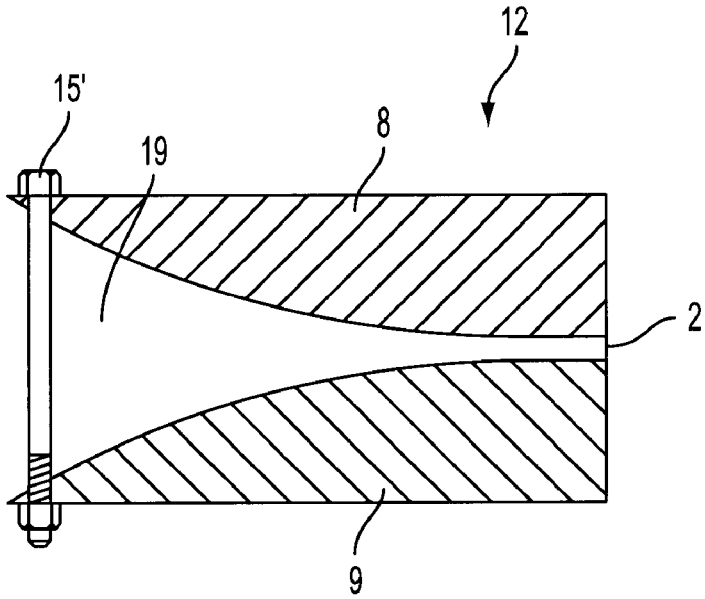

FIGS. 2 and 3 show two alternative configurations of gap mills 12. In all figures, the same reference numerals are used to designate parts of the same function.

In FIG. 2, the base body 9 is formed as a plane plate. Nevertheless, it is apparent that the constriction or space 19 narrows towards the gap 2, thus exerting a pressure in vertical direction, while leaving particles fed through inlets 5 to the effect of expanding forces both in longitudinal direction, i.e., the direction from the gap 2 towards the inlet 5, and in a direction perpendicular thereto.

In FIG. 3, base bodies 8, 9 are shown whose constriction 19 is curved. The inlets and outlets are not illustrated in FIG. 3. The two base bodies 8 and 9 may be rectangular, i.e., elongated in a direction perpendicular to the plane of FIG. 3, and held together by, e.g., a row of fasteners 15' (only one visible). These fasteners 15' are relatively slim and, therefore, do not adversely affect the expansion forces which, also in this case, act in the direction from the gap 2 to the left of FIG. 3, i.e., in a longitudinal direction of the flow, and concurrently laterally, i.e., in a direction perpendicular to the plane of FIG. 3 where the arrangement provides a free space to expand and does not constrict or compress them.

Figure 4:
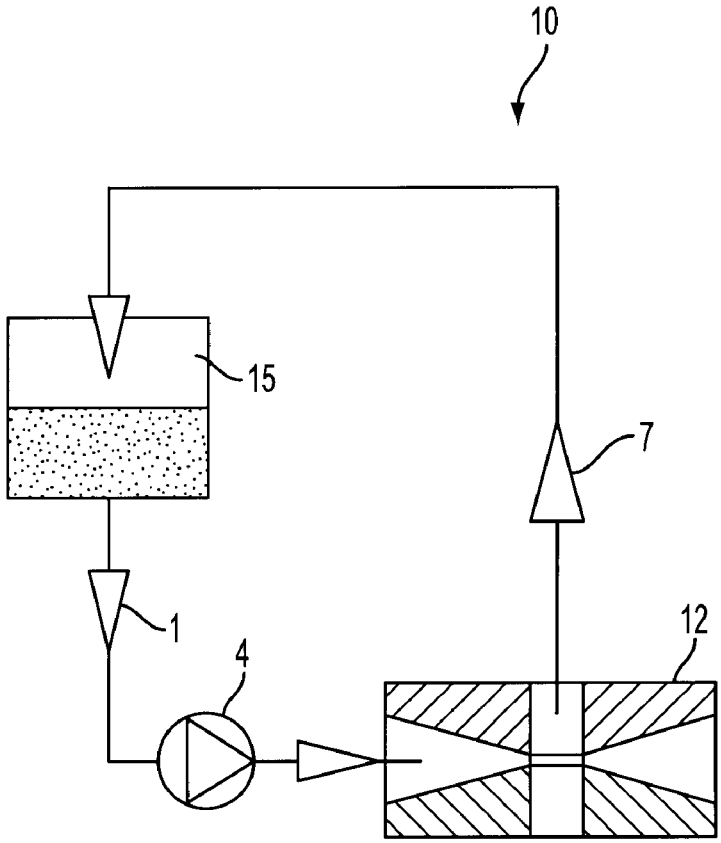
FIG. 4 shows a gap mill operated in a closed cycle of flow.

FIG. 4 shows a gap mill 12 operated in a closed cycle 10 of flow. The liquid material 1 to be treated is conveyed by a pump 4 from a container 16 through the gap mill 12, and the material 7 treated returns to the container 16, optionally for further treatment. In case a gaseous fluid is used having dispersed particles in it, a corresponding compressor would be used instead of a pump 4. Moreover, it is conceivable to use more than one pump or compressor.

Figure 5:
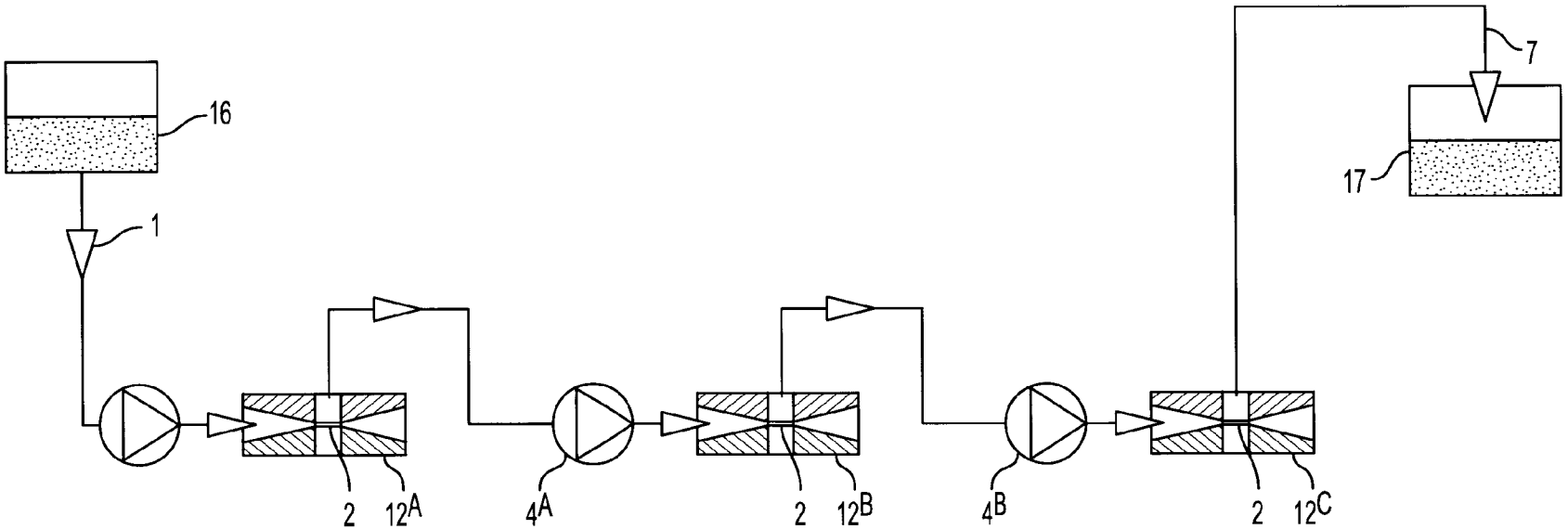
FIG. 5 is a series connection of gap mills.
Figure 6:
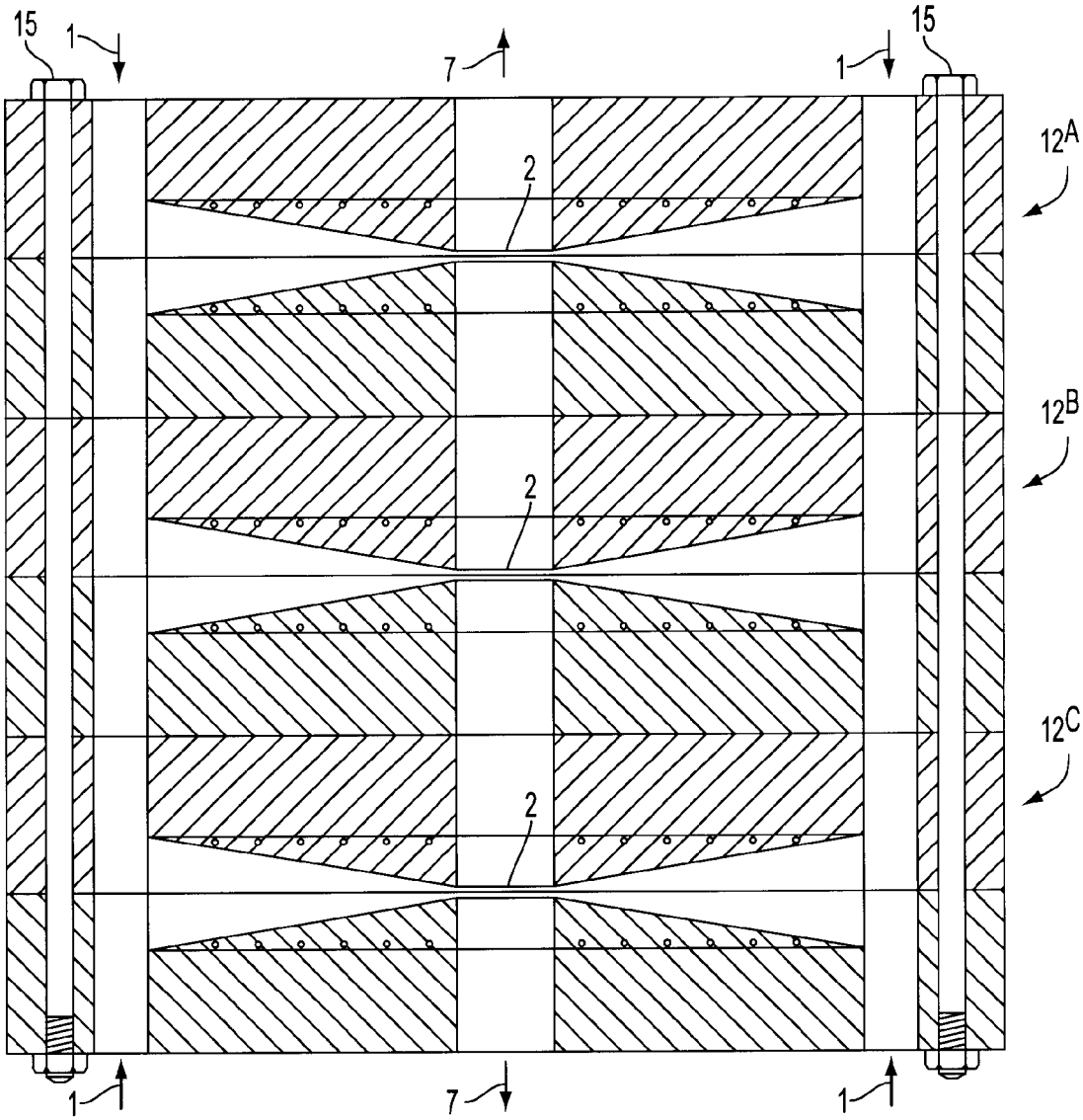
FIG. 6 depicts a parallel connection of gap mills.

In FIG. 5, three gap mills $\mathbf{12}^A$, $\mathbf{12}^B$ and $\mathbf{12}^C$ are connected in series, the material 1 and 7 being conveyed by pumps $\mathbf{4}^A$ and $\mathbf{4}^B$ from a supply container 16 to a receiving container 17. The constrictions or gaps 2 of those mills $\mathbf{12}^A$, $\mathbf{12}^B$ can have different cross-sections, becoming more and more narrow, for example, from one mill to another. In order to treat larger quantities of material 1, FIG. 6 shows a parallel connection of three gap mills $\mathbf{12}^A$, $\mathbf{12}^B$ and $\mathbf{12}^C$.

Figure 7:
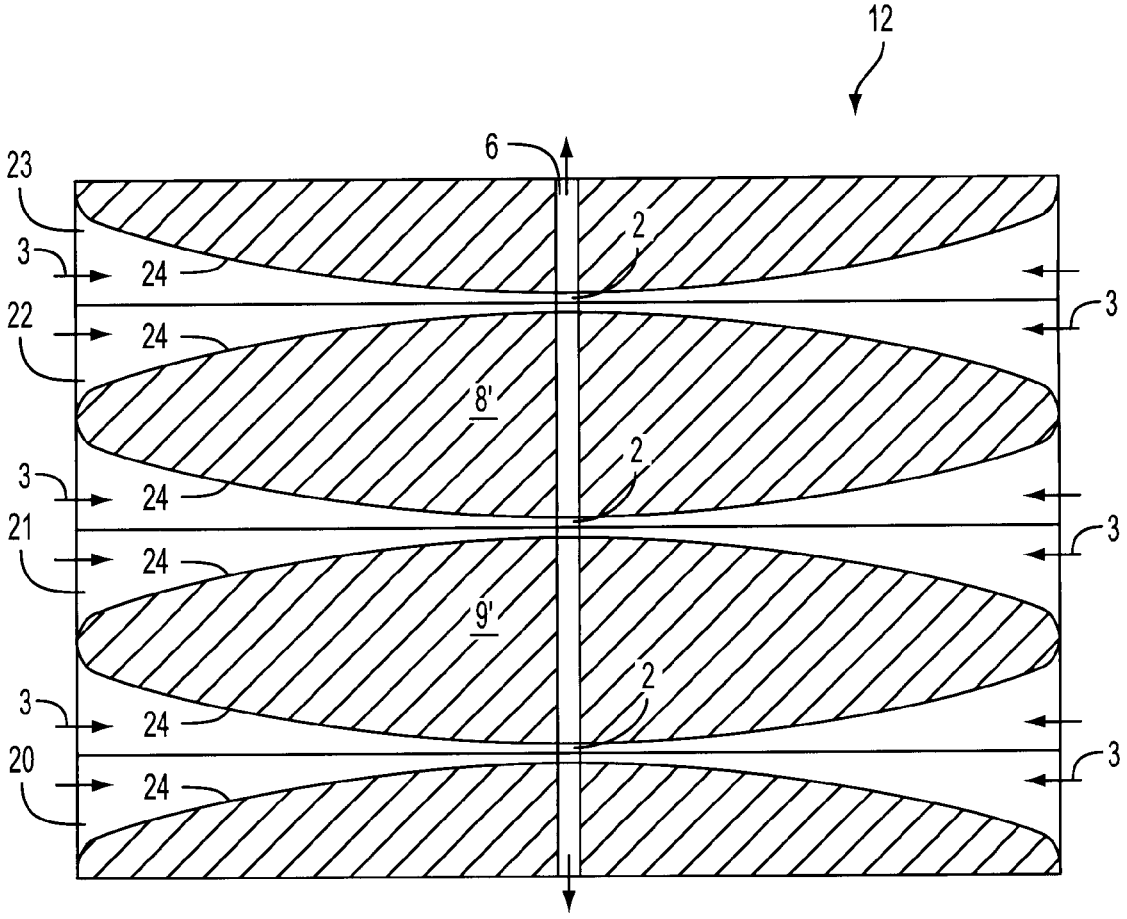
FIGS. 7 and 8 are further embodiments of a gap mill according to the present invention.

FIG. 7 illustrates a stack of four plates 20, 21, 22 and 23 which form three constrictions or gaps 2. These plates can be formed in the manner described above with reference to FIG. 1, i.e., being rectangular, its length extending perpendicularly to the plane of the figure, or substantially round when seen in a plan view. "Substantially round" refers to circular, oval or even polygon-shaped. Each plate has 20–23 has constricting wall surfaces 24, which, in this embodiment, are curved to form a "loaf-shape". While plates 20 and 23 are identical relative to each other and form half a loaf, plates 21 and 22 are also identical to one another, but form a complete loaf-shaped body 8' and 9'. Of course, it would be possible to have the plates 21 and 22 composed of two half-plates like the plates 20 and 23.

The direction of flow is shown by arrows 3 entering from both sides to leave the mill through the center outlet 6. Likewise, it is conceivable to operate the gap mills in halves, i.e., in the left-hand outer region is the inlet bore, and in the right-hand region (which corresponds to the center region in FIG. 1) is the outlet bore.

Figure 8:
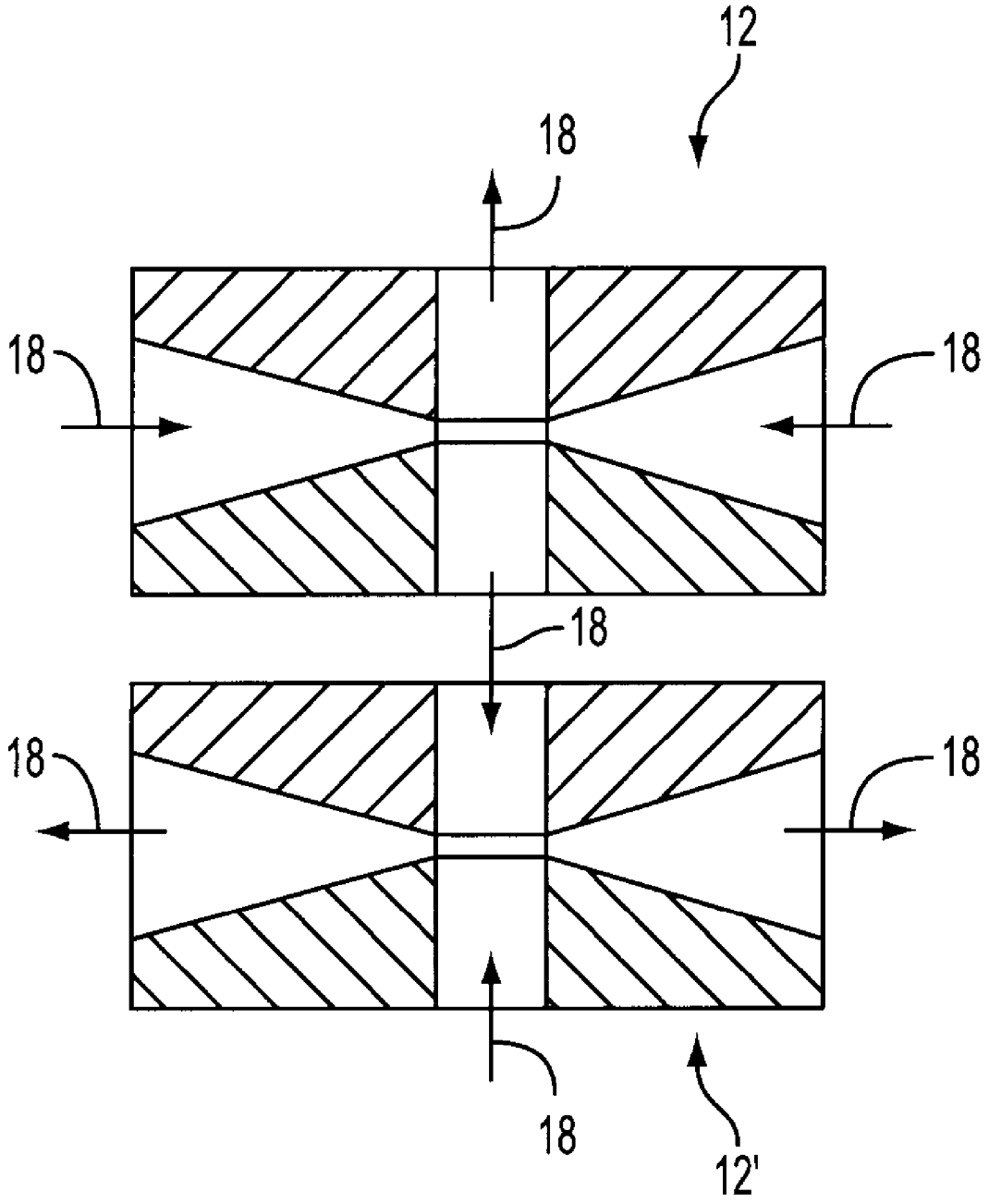

FIG. 8 shows two gap mills 12 and 12' in a series connection, the second gap mill 12' being operated in a reversed conveying direction according to arrows 18. In addition, it should be noted that, of course, a single gap mill could be operated with a reversed conveying direction. Likewise, it is conceivable that the inlet and the outlet are formed as a narrowing bore, i.e., entering through an inlet in the center region, while leaving the mill laterally.

Figure 9:
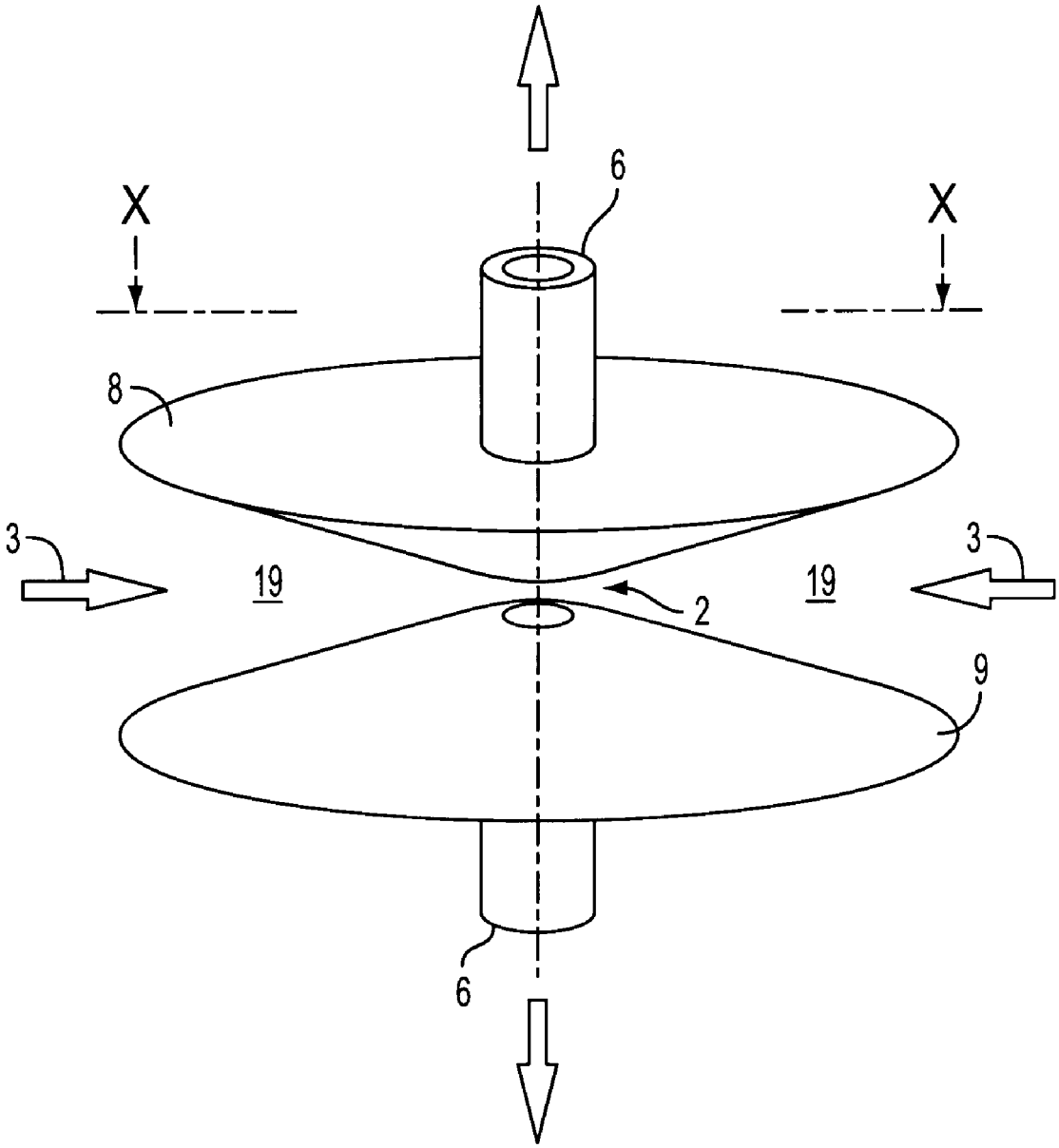
FIG. 9 shows a perspective view of two base bodies forming a milling space between them.

FIG. 9 shows two conical base bodies 8 and 9. The perspective view illustrates that the space 19 is free both in radial outward direction (to exert lengthwise expanding forces) and laterally, i.e., in perpendicular or circumferential direction to this radial direction so that particles are also subjected to expanding forces in width.

Figure 10:
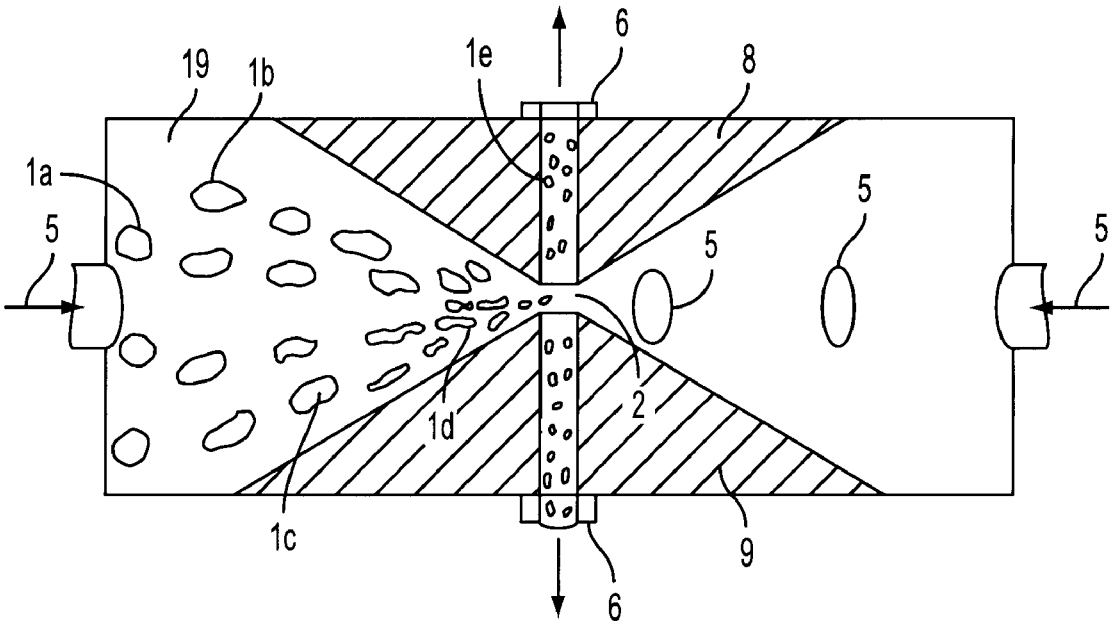
FIG. 10 is a cross-sectional view along a plane X—X of FIG. 9, but illustrating inlets and outlets of a gap mill formed by the base bodies of FIG. 9.

FIG. 10 illustrates the particles 1*a* being initially about circular in cross-section as they enter an annular inlet chamber that forms the space 19 together with the base bodies 8 and 9. The material is fed through a series of radially extending inlets 5 (represented more particularly on the right side of FIG. 10). The more the particles enter the constriction of the space 19 between the two base bodies 8 and 9, the more they are subjected to pressure from above and below. This causes them to expand in a longitudinal direction, but, due to the free space in a horizontal direction (see FIG. 9), they expand also in width, transversely to their direction of flow towards the annular gap 2. FIG. 10 shows slightly oval shapes of particles 1*b* at the entrance into the constricting space 19 which become more and more elongated (see particles 1*c*). Shortly before entering the gap 2, the particles are torn into fines 1*e*, as may be seen at 1*d*.

EXAMPLE

A lot of offset ink yellow of the Company AMRA, sold under the No. 007-0-01000, showed a relative large proportion (about>23%) of agglomerates under the microscope. These agglomerates had to be disagglomerated. To this end, a mill was used having two base bodies, as in FIG. 9, of a diameter of 100 mm each and forming an adjustable gap between them. This mill was arranged as dipicted in FIG. 4 in order to recirculate the liquid with the particles dispersed. Each batch was recirculated 12 times.

| Batch No. | gap dimension ($\mu$m) | pressure (bar) | throughput (kg/hour) | temperature (° C.) |
|---|---|---|---|---|
| 1 | 80 | 86 | 80 | 50 |
| 2 | 40 | 190 | 124 | 66 |
| 3 | 78 | 155 | 122 | 64 |

Batch No. 1 was treated with a relative wide gap and low pressure. The liquid remained first relatively viscous, but became more and more fluent. After passing the material 12 times through the milling arrangement, inspection under microscope showed that the agglomerates had diminished by about a third.

Batch No. 2 was, therefore, treated under more severe conditions. The dimension of the gap was made half as large as for batch No. 1. The pressure of the pump 4 was raised to 190 bar, while the throughput was also raised (see the table above). Temperature became correspondingly high (66° C.). Inspection after 12 passages showed under the microscope a practically homogeneous dispersion or mixture of fine particles in the liquid.

Batch No. 3 was then treated in order to test whether a comparable result could not be attained under less severe conditions, as seemed to be possible. This proved well, although the relative large gap left about 3% of medium-sized agglomerates. Nevertheless, the result was satisfying for practical purposes.

Therefore, some other tests were run reducing the gap more and more down to 30 $\mu$m and even to 20 $\mu$m. With such gap dimensions not only the agglomerates were reduced in size, but also the particles reaching partially 1 to 2, $\mu$m. During these supplemental tests, pressure increased partially up to a maximum of 500 bar.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. An apparatus for at least one of comminuting, dispersing, disagglomerating and mixing flowing material, said apparatus comprising:

a gap mill comprising a pair of cylindrical frustroconically shaped base bodies having a wide base surface and a truncated conical end, wherein each base body has an axially centered bore, said frustroconically shaped bodies being positioned so that said bores of said bodies are axially aligned, and form a thin gap between said truncated conical ends of said base bodies; and wherein an annular space is defined between said pair of base bodies of said gap mill.

2. The apparatus according to claim 1, wherein the annular space has a cross-sectional shape of two funnels connected together at their spout ends.

3. The apparatus according to claim 1, wherein the annular space has a cross-sectional shape of a hyperbola.

4. The apparatus according to claim 1, further comprising:

an outerjacket connected to said wide base surfaces of said pair of cylindrical frustro conical shaped base bodies arranged to enclose said annular space; and at least one inlet bore penetrating through said outer jacket;

wherein the flowing material enters said at least one inlet bore, flows through said annular space, enters said axially centered bores via the thin gap, and exits through one of said axially centered bores.

5. The apparatus according to claim 1, wherein a plurality of said gap mills are stacked together forming a "parallel connection" gap mill, said "parallel connection" gap mill comprising:

a plurality of axially centered bores axially aligned to form a central "series" bore having two main outlet exits, wherein each of the plurality of gap mills include an annular space;

at least two "series" inlet bores comprising a plurality of inlet bores, each at least one inlet bore is coupled to each annular space.

6. The apparatus according to claim 5, wherein each of the plurality of annular spaces has a cross-sectional shape of two funnels connected together at their spout ends.

7. The apparatus according to claim 5, wherein each of the plurality of annular spaces has a cross-sectional shape of a hyperbola.

8. The apparatus according to claim 1, further comprising at least one supply container and at least one pump arranged to form a closed-loop flow path such that the flow material continuously flows through said pump, said gap mill, and said supply container.

9. The apparatus according to claim 1, further comprising:

at least one supply container connected to a plurality of gap mills which are arranged so that said axially centered bores are axially aligned;

a pump arranged upstream of each gap mill; and a receiving container connected to the outermost said axially centered bores of said plurality of gap mills.

10. An apparatus for at least one of comminuting, dispersing, disagglomerating and mixing flowing material, said apparatus comprising:

a cylindrical frustroconically shaped body having a wide base surface, truncated conical end, and an axially centered bore; and a planar body;

said cylindrical frustroconically shaped body and said planar body being arranged to form an annular space, and a thin gap between said truncated conical end and said planar body.

11. A process for reducing a size of particles of a flowable material in a streaming fluid in an apparatus for at least one of comminuting, dispersing, disagglomerating and mixing flowing material, wherein the apparatus comprises a gap mill comprising a pair of cylindrical frustroconically shaped base bodies having a wide base surface and a truncated conical end, wherein each base body has an axially centered bore, said frustroconically shaped bodies being positioned so that said bores of said bodies are axially aligned, and form a thin gap between said truncated conical ends of said base bodies, wherein an annular space is defined between said pair of base bodies of said gap mill, the process comprising:

conveying the streaming fluid and the particles of flowable material under pressure;

subjecting said particles to expansion forces in a first dimension while simultaneously feeding the streaming fluid and the particles through the annular space; and subjecting said particles to expansion forces in a second dimension while being conveyed through the annular space.

12. The process of claim 11, wherein said conveying comprises conveying the particles of flowable material by at least one pump.

13. The process of claim 11, wherein the conveying comprises feeding the particles of flowable material through a plurality of constrictions.

14. The process of claim 13, wherein the plurality of constrictions are arranged in series.

15. The process of claim 13, wherein the plurality of constrictions are arranged in parallel.

16. The process of claim 11, further comprising recirculating the particles of a flowable material.

17. A process for reducing a size of particles of a flowable material in a streaming fluid in an apparatus for at least one of comminuting, dispersing, disagglomerating and mixing flowing material, wherein the apparatus comprises a cylindrical frustroconically shaped body having a wide base surface, truncated conical end, and an axially centered bore, a planar body, the cylindrical frustroconically shaped body and the planar body being arranged to form an annular space, and a thin gap between the truncated conical end and the planar body, the process comprising:

conveying the streaming fluid and the particles of flowable material under pressure;

subjecting said particles to expansion forces in a first dimension while simultaneously feeding the streaming fluid and the particles through the annular space; and subjecting said particles to expansion forces in a second dimension while being conveyed through the annular space.

18. The process of claim 17, wherein said conveying comprises conveying the particles of flowable material by at least one pump.

19. The process of claim 17, wherein the conveying comprises feeding the particles of flowable material through a plurality of constrictions.

20. The process of claim 19, wherein the plurality of constrictions are arranged in series.

21. The process of claim 19, wherein the plurality of constrictions are arranged in parallel.

22. The process of claim 17, further comprising recirculating the particles of a flowable material.

23. An apparatus for reducing a size of particles of a flowable material in a streaming fluid, the apparatus comprising:

a first body comprising a first surface which is at least one of curved and straight, a base portion, and an opening which defines an outlet for the flowable material;

a second body comprising a second surface which is one of curved and straight;

a narrowing space being defined between the first surface and the second surface;

the narrowing space having an inlet end and an outlet end and narrowing from the inlet end to the outlet end; and a thin gap being disposed at the outlet end of the narrowing space, wherein the outlet for the flowable material communicates with the thin gap, and wherein the first body and the second body are at least one of non-rotatably mounted to each another and fixedly mounted to each other.

* * * * *